United States Patent [19]

Zollinger

[11] Patent Number: 4,807,829

[45] Date of Patent: Feb. 28, 1989

[54] COMBINED YARN TENSIONING CONTROL AND STOP MOTION UNIT

[75] Inventor: Otto Zollinger, Spartanburg, S.C.

[73] Assignee: Otto Zollinger, Inc., Spartanburg, S.C.

[21] Appl. No.: 157,643

[22] Filed: Feb. 18, 1988

[51] Int. Cl.[4] ..... B65H 59/22

[52] U.S. Cl. ..... 242/152.1; 242/36; 242/37 R; 242/49; 200/61.18; 340/677

[58] Field of Search ..... 242/152.1, 149, 150 R, 242/150 M, 151, 152, 153, 154, 147 R, 147 M, 147 A, 148, 36, 37 R, 49; 226/195; 200/61.18, 61.13; 340/677

[56] References Cited

U.S. PATENT DOCUMENTS

| | | | |
|---|---|---|---|
| Re. 30,920 | 5/1982 | Zollinger | 242/152.1 |
| Re. 31,041 | 9/1982 | Zollinger | 242/152.1 |
| 2,222,847 | 11/1940 | Kent | 242/37 R |
| 3,343,008 | 9/1967 | Bancroft | 242/36 X |
| 3,561,689 | 2/1971 | Morgan | 242/37 R |
| 3,734,422 | 5/1973 | Loepfe | 242/37 R X |
| 3,863,241 | 1/1975 | Kamiyamaguchi | 242/37 R X |
| 4,027,232 | 5/1977 | Domig et al. | 242/36 X |
| 4,256,247 | 3/1981 | Loepfe | 242/36 |

*Primary Examiner*—Stanley N. Gilreath
*Attorney, Agent, or Firm*—Shefte, Pinckney & Sawyer

[57] ABSTRACT

A combined ball tension control and stop motion unit in which the exit opening of the ball housing of the ball tension control component is mounted to the stop motion component. An interior yarn guide is mounted in an opening in the stop motion housing and projects into the outlet end of the ball housing. An electronic sensing element on a printed circuit board partially surrounds the yarn passage above the interior yarn guide and an exterior yarn guide is mounted above the printed circuit board for guiding yarn as it exits the unit. The exterior yarn guide may be of the type that is used in the ball housing when the ball tension control component is used separately without combination with the stop motion component.

7 Claims, 3 Drawing Sheets

COMBINED YARN TENSIONING CONTROL AND STOP MOTION UNIT

BACKGROUND OF THE INVENTION

The present invention relates to a yarn tensioning control and to a yarn stop motion, and more particularly to a combination of a ball tensioning control and an electronic stop motion.

Controlling the tension of yarn to obtain uniform tension of yarn feed in textile equipment and other equipment that manufactures or processes yarns and other types of strand material is an important aspect of obtaining quality in the material produced. Exceptionally proficient uniform yarn tensioning is obtained using a ball tension control of the type disclosed in the inventor's prior U.S. Pat. Nos. Re. 30,920, Re. 31,024 and Re. 31,041.

Preferably, such ball tension controls are mounted relatively close to the yarn supply, e.g. a bobbin or package, to minimize amplification of irregularity in tension caused by variations in friction during drawing of the yarn from the supply. Yarn breaks usually result from either a weakness at a point in the yarn being fed such that the tension applied by the ball tension control is greater than the strength of the yarn at the weak point or excessive resistance or friction as the yarn is withdrawn from the supply due to imperfections in the previous preparation of the supply, such as in winding of a package or bobbin preparatory to use in the equipment at which the yarn is supplied.

In addition to yarn tension controls, textile equipment and other types of strand processing equipment include stop motions that sense a break in the yarn or strand and signal a stoppage of the operation of the equipment until the break is repaired. The prior art is replete with various types of stop motions that operate mechanically, optically, electronically or otherwise, with electronic stop motions having an advantage of quick response. Stop motions are conventionally separate units from tension control units and located at a substantial spacing therefrom.

It has been discovered that when using ball tension controls most yarn breaks occur adjacent the supply and commonly immediately after the yarn passes the application or tension by the ball. This results in a time delay between the actual break and the sensing of the break by a stop motion located at a spacing from the ball tension control. Such time delay results in an increment of production by the equipment without uniform tension of the yarn feed, with resultant imperfection in the ultimate product.

SUMMARY OF THE INVENTION

By the present invention a ball tension control and an electronic stop motion are efficiently combined as a single unit so that the stop motion can be activated immediately at the occurrene of a yarn break without delay, and the two components require only a single mounting in contrast to having spaced separate units requiring individual mounting.

Briefly described, the combined yarn tensioning control and stop motion unit of the present invention includes a ball tension control component having a ball housing formed with a yarn inlet, a yarn outlet, a yarn passageway between the inlet and outlet, a ball seat in the passageway through which yarn passes, and ball means associated with the ball seat for applying tension control to yarn traveling through the passageway. The unit also includes a yarn sensing stop motion component having a housing containing electronic circuitry, with the stop motion housing having an annular yarn passageway therethrough disposed at the yarn outlet of the tension control component and having means for sensing yarn traveling through the annular passageway. Preferably, the annular passageway of the stop motion component is disposed in the outlet of the tension control component. The electronic circuitry is responsive to the sensing means to provide a stop motion signal. The sensing means may sense the absence of movement of a yarn in the annular passageway, such as occurs when a year breaks, or it may sense yarn traveling through the annular passageway at a rate less than a predetermined rate, which can occur when a break is about to happen or when there is a non-uniformity in the feed rate or tension which could result in imperfections in the ultimate product if the equipment is not stopped.

In the preferred embodiment annular yar guide means are provide for guiding yarn from the yarn outlet through the annular passageway of the stop motion component. The guide means may include an interior yarnguide and an exterior yarn guide with the sensing means including a yarn sensing element disposed between the yarn guides.

As an added feature, the ball tension control component is formed with an annular flange at the yarn outlet for mounting of a yarn guide therein, with the interior yarn guide being mounted in both the annular flange and the annular passageway of the stop motion component. The exterior yarn guide is mounted in the annular passageway of the stop motion component housing and is shaped for mounting in the annular flange of the ball tension control component for alternate use of the ball tension control component and exterior yarn guide separate from combination with a stop motion component.

DETAILED DESCRIPTION OF THE PREFERRED EMBODIMENT

Figure 1:
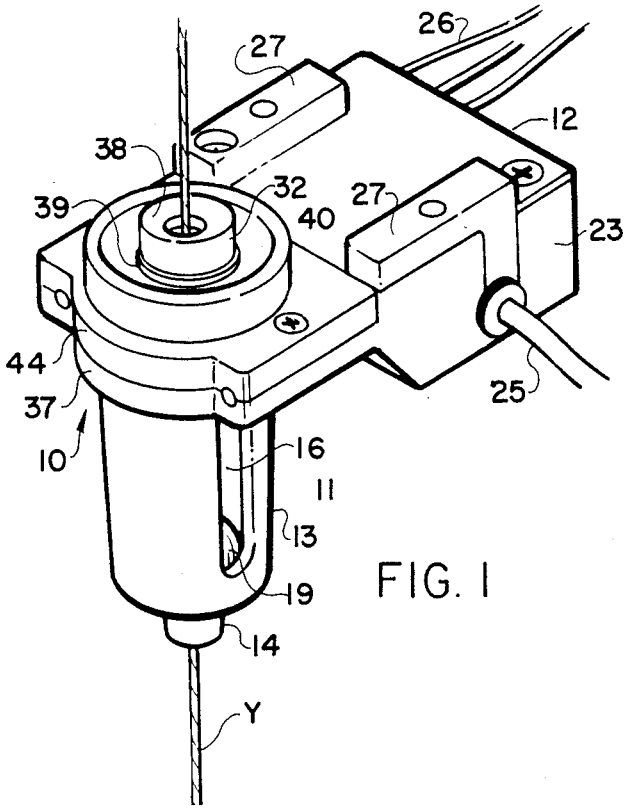
FIG. 1 is a perspective view of a combined yarn tensioning control and stop motion unit accordign to the preferred embodiment of the present invention.
Figure 2:
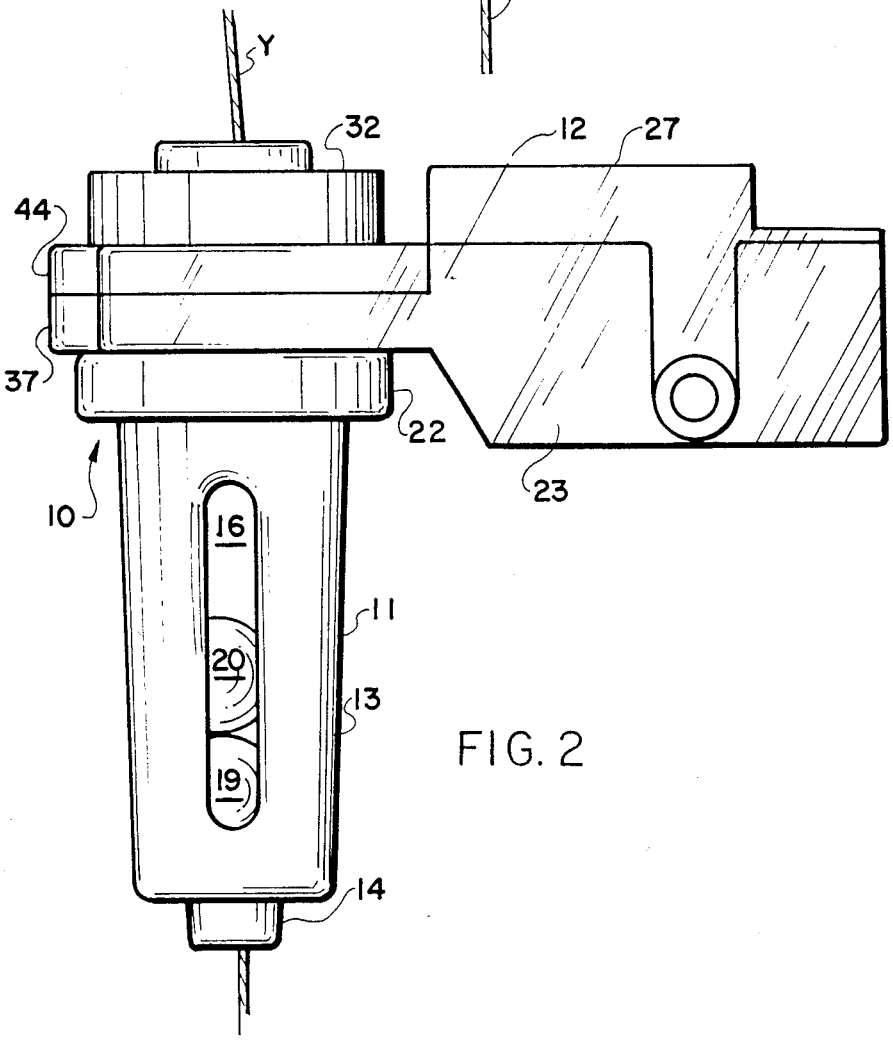
FIG. 2 is a side elevation of the unit of FIG. 1.
Figure 3:
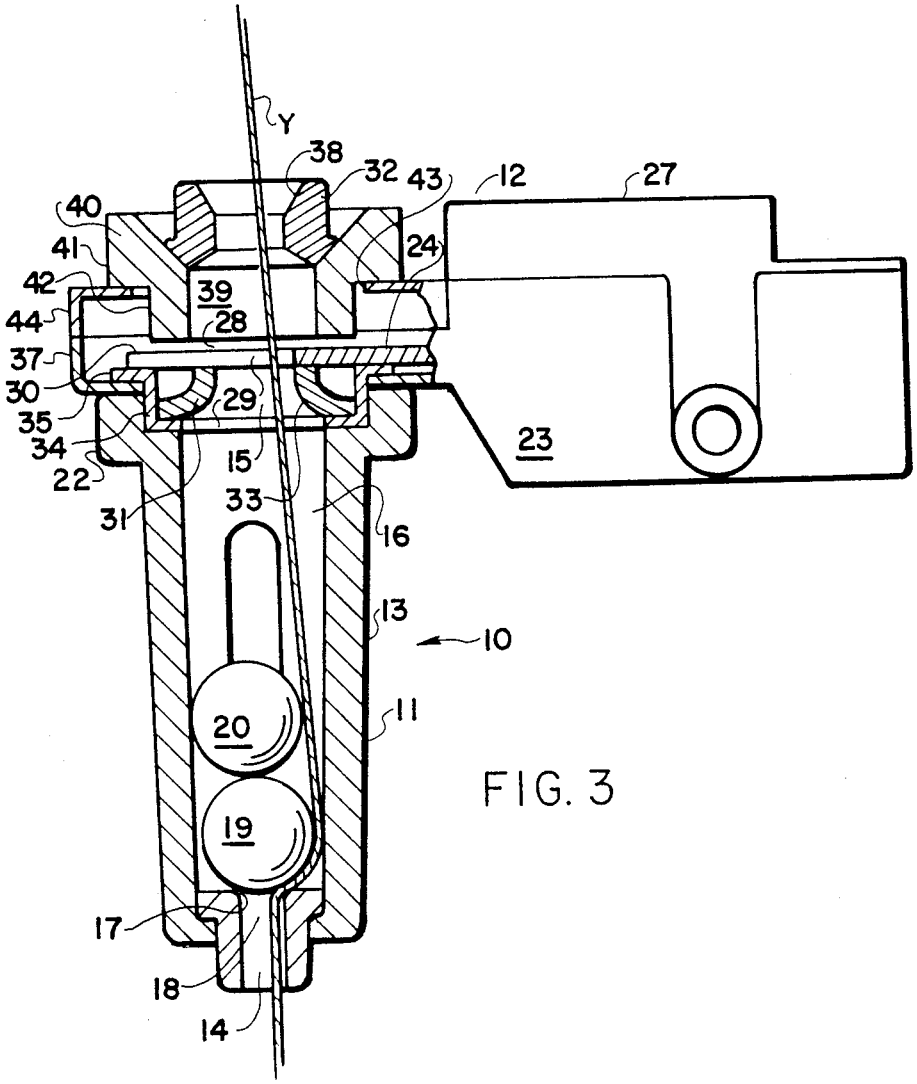
FIG. 3 is a vertical section through the center of the unit illustrated in FIG. 2.

Referring to the drawings, the preferred embodiment of the combined yarn tensioning control and stop motion unit 10 of the present invention is illustrated as having a ball tension control component 11 and a yarn sensing stop motion control 12. The ball tension control component 11 includes a generally cylindrical ball housing 13 having a yarn inlet 14 at its bottom end and a yarn outlet 15 at its top end, with a passageway 16 extending therebetween through the housing 13. An annular ball seat 17 is mounted in the yarn inlet 14 in the passageway 16. The ball seat 17 has a central opening 18 through which yarn Y passes upwardly into and through the passageway 16. Ball means in the form of a pair of balls 19,20 are contained in the ball housing 13 with the lower ball 19 associated with the ball seat 17 and the upper ball 20 resting on top of the lower ball 19. The balls 19,20 apply tension control to the yarn Y traveling thorugh the ball seat 17 and housing 13. When there is no yarn in the unit the lower ball 19 seats on the ball seat 17 and when yarn is in the unit but is either not moving or is moving under light tension the lower ball 19 will remain seated on the ball seat 17. When a normal running condition exists, and particularly when there is substantial tension, the yarn will raise the ball from the seat 17 with the weight of the balls applying tension to the yarn.

The top of the ball housing 13 is formed with an annular flange 22 at the yarn outlet 15 for mounting therein of a yarn guide.

The elements described up to this point are elements of ball tension control units used heretofore without combination with a stop motion.

The aforementioned yarn sensing stop motion component 12 includes a housing 23 in which electronic circuitry, including a printed circuit board 24 is contained. An electrical power lead 25 and control signal leads 26 extend into and from, respectively, the electronic circuitry within the housing 23. Upstanding mounting bars 27 are formed on the top of the housing 23 for attachment to a fixture of the equipment with which the unit 10 is associated for operation.

An annular yarn passageway 28 is formed in the stop motion component housing 23 at the yarn outlet of the ball housing 13. In the preferred embodiment illustrated, the passageway 28 of the stop motion component 12 extends into the yarn outlet 15. Mounted in the passageway 28 of the stop motion component 12 is means for sensing yarn traveling through the annular passageway 28 in the form of an electronic sensing element 29 that is a semi-circular flat disk secured in a recess 30 in the printed circuit board 24 at the periphery of the passageway 28 in the housing 23 of the stop motion component 12. This sensing element 29 in combination with the electronic circuitry of the printed circuit board 24 senses whether a yarn Y is present in the passageway 28, the electronic circuitry being responsive to sensing of no yarn in the passageway to provide a stop motion signal through the control signal leads 26 to the operating controls of the equipment with which the unit is associated. Alternatively, the sensing element 29 and associated electronic circuitry of the printed circuit board 24 may be programmed to sense whether yarn is traveling at normal operating speed through the passageway 28 and to sense when a yarn is traveling at a rate less than a predetermined rate, such as when there is undesirable fluctuation in the feed rate or when the yarn speed is decreasing due to an impending break, such that the equipment can be stopped as quickly as possible in relation to a break or imperfection.

The yarn Y is guided from the yarn outlet 15 through the yarn passageway 28 of the stop motion component 12 by annular yarn guide means 31,32 in the form of an interior annular yarn guide 31 and an exterior annular yarn guide 32. These yarn guides 31,32 are mounted in the housing 23 of the yarn sensing stop motion component 12 in alignment with the yarn outlet 15 of the ball housing 13 of the ball tension control component 11. The aforementioned sensing element 19 is disposed between the yarn guides 31 and 32.

The interior yarn guide 31 is in the form of a ceramic ring having a trumpet-like downwardly flaring annular yarn guiding surface 33. The interior yarn guide 31 is secured in an annular cylindrical mounting 34 that has a top flange 35 for positioning in an annular recess 36 in the lower portion 37 of the stop motion housing 23 at the perimeter of the passageway 28. With this arrangement the mounting 34 and interior yarn guide 31 project downwardly from the lower poriton 37 of the housing 28 for mounting within the flange 22 of the ball housing 13 at the yarn outlet 15. With this arrangement the interior yarn guide 31 is actually in the yarn outlet 15, itself, in substantially the same position that a yarn guide of a separate ball tension control would be located.

The exterior yarn guide 32 is in the form of a ceramic insert having a trumpet-like upwardly flaring surface 38 over which the yarn Y is guided as it leaves the unit 10. The exterior yarn guide 32 is fixed in the center opening 39 of an annular mounting element 40 which has a peripheral shoulder 41 from which a reduced cylindrical portion 42 projects for mounting of the mounting element 40 and associated exterior yarn guide 32 in an annular opening 43 in the upper portion 44 of the stop motion housing 23 in line with and forming an extension of the annular passageway 28 therein.

It should be noted that the mounting element 40 may actually be in the form of a top yarn guide of a ball tension control unit that is not combined with a stop motion. Thus, a new construction is not required for this part and the same part can be used in either a separate ball tension control unit or in the combined ball tension control and stop motion unit of the present invention. For use of the mounting element 40 in a ball tension control unit without a stop motion, the reduced cylindrical portion 42 fits in the flange 22 of the ball housing 13. The exterior yarn guide 32 used in the unit of the present invention may be included with the mounting element 40 or the mounting element 40 may be used as a yarn guide itself either when the mounting element 40 is used in a combined unit or when no stop motion is combined.

As the ball tension control component 11 is mounted on the housing 23 of the stop motion component 12, the entire unit 10 is mounted to an associated fixture at the aforementioned mounting bars 27, and the usual mounting bracket used to mount a ball tension control unit is not needed.

Figure 4:
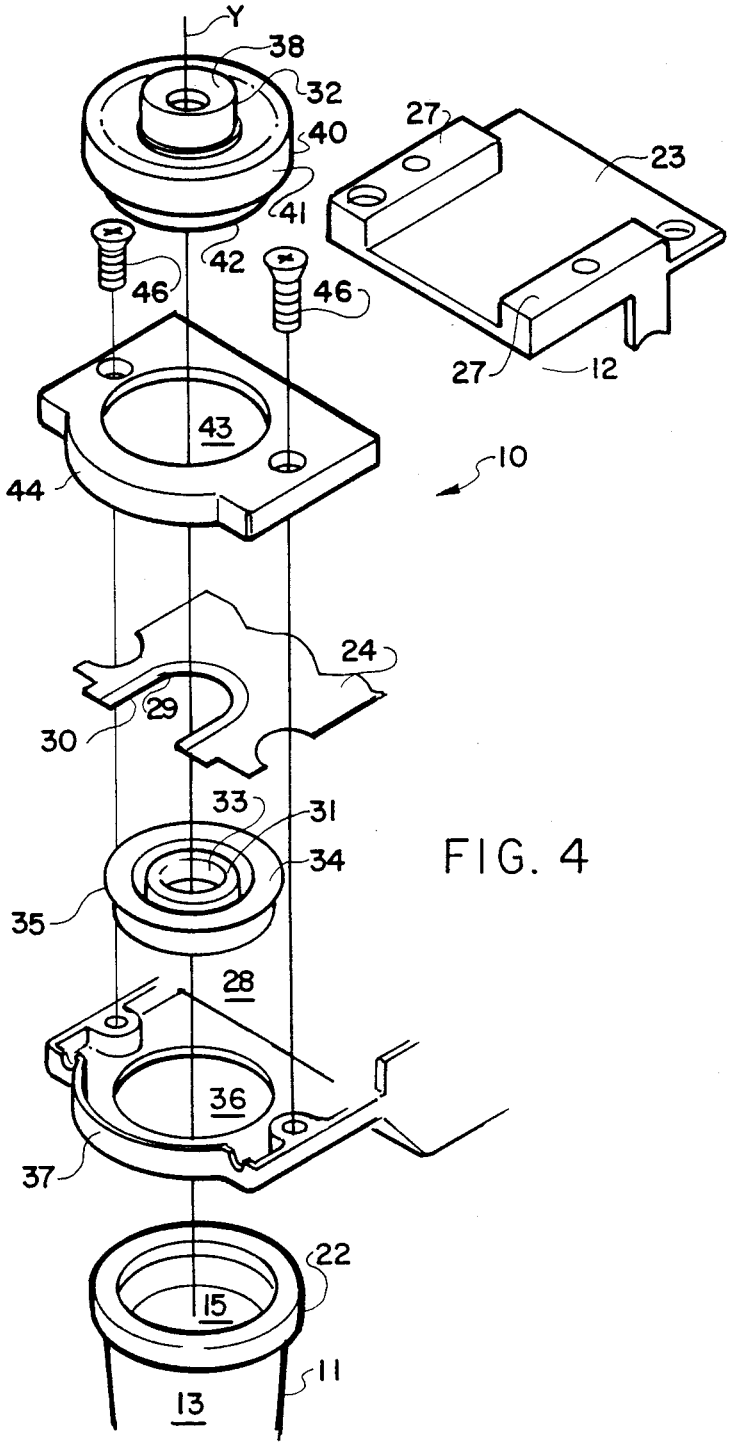
FIG. 4 is an enlarged exploded perspective of the elements of the unit of FIG. 3.

The elements of the stop motion component 12 and the assembly with the ball tension control component 11 to form the combined unit 10 were illustrated in the exploded view of FIG. 4, in which it is seen that the interior yarn guide 31 in its mounting 34 is inserted in the opening 36 in the lower portion 37 of the stop motion housing 23 with the top flange 35 of the mounting 34 seated on the adjacent portion of the lower housing portion 37. The printed circuit board 24 and sensing element 29 are conventional components of a known electronic stop motion unit and do not, in themselves, form a part of the invention, nor does the operation of the stop motion component in generating stop motion signals. The printed circuit board 24 with the sensing element 29 secured thereto is positioned on top of the mounting 24 with the sensing element 29 partially surrounding the passageway 28. The upper portion 44 of the stop motion housing 23 is positioned on top of the lower portion 37 and secured in place by screws 46. The mounting element 40 containing the exterior yarn guide 32 is secured in the opening 43 of the upper portion 44 of the stop motion housing 23. To complete the assembly, the mounting 34 that has the interior yarn guide 31 therein is secured in the flange 22 of the ball housing 13 at the yarn outlet 15 of the ball tension control 11.

The combined unit 10 is preferably mounted close to a yarn supply. For example, when used to guide yarn from a package of yarn on a cone, the unit is preferably located at a spacing from the cone of one and one-half to two times the length of the cone. This spacing, of course, depends on the circumstances and may vary to obtain best results in particular uses.

In the specification and claims reference is made to yarn, but it should be understood that the use of this term encompasses other forms of strands processed in textile equipment and in equipment other than textiles.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

I claim:

1. A combined yarn tensioning control and stop motion unit comprising a ball tension control component having a ball housing formed with a yarn inlet, a yarn outlet, a yarn passageway between said inlet and outlet, a ball seat in said passageway through which yarn passes, and ball means associated with said ball seat for applying tension control to yarn traveling through said passageway, and a yarn sensing stop motion component having a housing containing electronic circuitry, said stop motion housing having an annular yarn passageway therethrough disposed at said yarn outlet, and means for sensing yarn traveling through said annular passageway, said electronic circuitry being responsive to said sensing means to provide a stop motion signal.

2. A combined yarn tensioning control and stop motion unit according to claim 1 and characterized further in that said sensing means senses the absence of movement of a yarn in said annular passageway.

3. A combined yarn tensioning control and stop motion until according to claim 1 and characterized further in that said sensing means senses yarn traveling through said passageway at a rate less than a predetermined rate.

4. A combined yarn tensioning control and stop motion unit according to claim 1, 2 or 3 and characterized further in that said annular passageway of said stop motion component is disposed in said outlet of said tension control component.

5. A combined yarn tensioning control and stop motion unit according to claim 4 and characterized further by annular yarn guide means for guiding yarn from said yarn outlet through said annular passageway of said stop motion component.

6. A combined yarn tensioning control and stop motion unit according to claim 5 and characterized further in that said yarn guide means includes an interior yarn guide and an exterior yarn guide and said sensing means includes a yarn sensing element disposed between said yarn guides.

7. A combined yarn tensioning control and stop motion unit according to claim 6 and characterized further in that said housing of said ball tension control component is formed with an annular flange at said yarn outlet for mounting of a yarn guide therein, said interior yarn guide is mounted in both said annular flange of said ball tension control component and said annular passageway of said stop motion component, and said exterior yarn guide is mounted in said annular passageay of said stop motion component housing and is shaped for mounting in said annular flange of said ball tension control component for alternate use of said ball tension control component and exterior yarn guide separate from said stop motion component.

* * * * *

UNITED STATES PATENT AND TRADEMARK OFFICE

CERTIFICATE OF CORRECTION

PATENT NO. : 4,807,829

DATED : February 28, 1989

INVENTOR(S) : Otto Zollinger

It is certified that error appears in the above-identified patent and that said Letters Patent is hereby corrected as shown below:

Column 1, Line 58 Delete "occurrene" and substitute -- occurrence --.

Column 2, Line 21 Delete "yar" and insert -- yarn --.

Column 2, Line 26 Delete "yarnguide" and insert -- yarn guide --.
Column 2, Line 44 Delete "accordign" and insert -- according --.
Column 3, Line 3 Delete "thorugh" and insert -- through --.
Column 3, Line 63 Delete "19" and add -- 29 --.
Column 4, Line 5 Delete "poriton" and insert -- portion --.
Column 4, Line 59 Delete "24" and insert -- 34 --.
Column 6, Line 10 Delete "until" and insert -- unit --.
Column 6, Line 37 Delete "passageay" and insert -- passageway --.

Signed and Sealed this

Ninth Day of October, 1990

*Attest:*

HARRY F. MANBECK, JR.

*Attesting Officer*

*Commissioner of Patents and Trademarks*